US007484729B2

(12) United States Patent
Ono et al.

(10) Patent No.: US 7,484,729 B2
(45) Date of Patent: Feb. 3, 2009

(54) IMAGE FORMING APPARATUS

(75) Inventors: Akehiro Ono, Nagoya (JP); Masahiro Kamimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 451 days.

(21) Appl. No.: 11/005,032

(22) Filed: Dec. 7, 2004

(65) Prior Publication Data

US 2005/0140086 A1 Jun. 30, 2005

(30) Foreign Application Priority Data

Dec. 25, 2003 (JP) ..... 2003-429241

(51) Int. Cl.
*B65H 31/00* (2006.01)
*B65H 31/04* (2006.01)

(52) U.S. Cl. ..... 271/209; 271/213; 271/207

(58) Field of Classification Search ..... 271/207, 271/209, 220, 224, 161, 223, 213, 171; 347/104; 399/406, 405

See application file for complete search history.

(56) References Cited

U.S. PATENT DOCUMENTS 5,111,252 A * 5/1992 Hamada et al. ..... 399/393
5,984,299 A * 11/1999 Hirota et al. ..... 271/161
6,065,747 A * 5/2000 Khovaylo et al. ..... 271/209
6,070,868 A * 6/2000 Nagato et al. ..... 271/145
6,095,516 A * 8/2000 Sawano et al. ..... 271/207
6,126,164 A * 10/2000 Rennick et al. ..... 271/223
6,227,536 B1 * 5/2001 Bethke ..... 271/207
6,428,000 B1 * 8/2002 Hara et al. ..... 271/223
6,612,561 B2 * 9/2003 Sekine ..... 271/3.14
6,810,231 B2 * 10/2004 Kobayashi et al. ..... 399/367
7,099,618 B2 * 8/2006 Iwago et al. ..... 399/367
7,263,327 B2 * 8/2007 Nagayama ..... 399/405

FOREIGN PATENT DOCUMENTS

JP A 09-208110 8/1997
JP B2 3402904 2/2003
JP A 2003-104616 4/2003

* cited by examiner

*Primary Examiner*—Patrick H Mackey
*Assistant Examiner*—Luis Gonzalez
(74) *Attorney, Agent, or Firm*—Oliff & Berridge, PLC

(57) ABSTRACT

An image forming apparatus includes a loading portion that is capable of receiving a recording sheet. The loading portion includes a correction member which has a bending portion, wherein the bending portion selectively moves between a first position and a second position, the second position being located higher than the first position, and a stopper that selectively moves between a closed position and an open position in which the stopper extends upward at a predetermined angle with respect to a horizontal surface when the stopper is at the open position.

17 Claims, 6 Drawing Sheets

RELATED ART

IMAGE FORMING APPARATUS

INCORPORATION BY REFERENCE

This application claims priority from Japanese Patent Application No. 2003-429241, filed Dec. 25, 2003, the subject matter of which is incorporated herein in its entirety by reference thereto.

BACKGROUND OF THE INVENTION

1. Field of Invention

This invention relates to an image forming apparatus having a paper output tray.

2. Description of Related Art

Laser printers exist in which a toner image is formed on a sheet that has been output from a paper supply cassette. Heat and pressure are then added at a fixing portion in order to fix the toner image to the sheet. The sheet is then output, using an output roller, onto a paper output tray.

Various types of sheets are used in the laser printer. For example, an ordinary sheet (approximately 60-100 g/m$^2$), a thick sheet (100-200 g/m$^2$), a transparent sheet for an overhead projector, and a label sheet are used. Depending on the type of sheet and the environment of the laser printer, such as humidity, at the time of printing, the sheet can curl into a cylindrical shape. The sheet can curl due to heat and pressure added at the time of fixing. A curled sheet is thus output to the output tray. When the curled sheet is output, there is a possibility that a loading failure might occur. The loading failure may occur, for example, when a sheet that has been previously output is pushed from the paper output tray by a sheet that is currently being output.

An image forming apparatus, in Japanese Patent No. 3,402,904, for example, arranges a link connecting portion in a paper output tray that can deform the paper output tray depending on the type of sheet. As shown in FIG. 6, the link connecting portion 153 is extended in a direction perpendicular to a direction in which a sheet is output to a paper output tray 151. As the link connecting portion 153 moves up and down by a gear, the shape of the paper output tray 151 can deform in a convex or a concave shape, wherein the link connecting portion 153 is the vertex.

When the sheet typically curls upward from a center of the sheet toward an end of the sheet in the width direction at the time of heating, the curling of the sheet can be corrected by upwardly moving the link connecting portion 153. The paper output tray 151 is also formed in a convex shape in order to match the shape of the sheet.

There also exists an imaging forming apparatus that arranges a stopper in a paper output tray and suppresses the slippage of an output sheet from the paper output tray. The stopper is positioned on a downstream side in a sheet output direction and the tip of the stopper is inclined upwardly at a predetermined angle. The output sheet is interrupted when the output sheet contacts the stopper. As such, the stopper suppresses the sheet from slipping from a contact position to a front side.

SUMMARY OF THE INVENTION

In order to correct the curling of a sheet and suppress the sheet from slipping from a paper output tray, Japanese Patent No. 3,402,904 discloses a stopper that is arranged in a paper output tray having a link connecting portion.

The stopper is positioned so that the angle with respect to the paper output tray is constant. If a link connecting portion is moved depending on the type of sheet, the inclination of the paper output tray is changed. According to the change, the position of the stopper is also changed.

For example, when the link connecting portion is moved upwardly, and the paper output tray is in a convex shape, the stopper which is fixed to the paper output tray becomes horizontal according to the inclination of the paper output tray. However, if the paper output tray is positioned downward with respect to the horizon, there is a possibility that slipping of the sheet cannot be sufficiently suppressed. In order to suppress the sheet from slipping, it is thus desirable to locate the tip of the stopper upward at a predetermined angle with respect to the horizon.

This invention thus provides an image forming apparatus that corrects the curling of a sheet generated at the time of image formation. The sheet is also suppressed from slipping from the paper output tray.

An exemplary image forming apparatus may include a loading portion that is capable of receiving a recording sheet. The loading portion includes a correction member which has a bending portion that divides the loading portion into an upstream side and a downstream side, wherein the bending portion can selectively move between a first position and a second position, the second position being located higher than the first position, and a stopper that selectively moves between a closed position in which the stopper is stored in the correction member and an open position in which the stopper moves toward the downstream side of the correction member, wherein the stopper extends upward at a predetermined angle with respect to a horizontal surface when the stopper is in the open position.

An exemplary image forming apparatus may include a loading portion that is capable of receiving a recording sheet, wherein the loading portion includes a correction member which has a bending portion that divides the loading portion into an upstream side and a downstream side, and a stopper that is movable relative to the correction member. The correction member and the stopper is capable of selectively achieving: a first state where the correction member is at a first position and the stopper is at a closed position, a second state where the correction member is at the first position and the stopper is at an open position where the stopper moves toward the downstream side of the correction member and extends upward at a predetermined angle with respect to a horizontal surface, a third state where the correction member is at a second position that is located higher than the first position and the stopper is at the closed position, and a fourth state where the correction member is at the second position and the stopper is at the open position.

An exemplary image forming apparatus may include a loading portion that is capable of receiving a recording sheet. The loading portion includes a correction member which has a bending portion, wherein the bending portion can selectively move between a first position and a second position that is located higher than the first position, and a stopper that selectively moves between a closed position and an open position in which the stopper extends upward at a predetermined angle with respect to a horizontal surface.

An exemplary method of operating a loading portion that is capable of receiving a recording sheet, wherein the loading portion includes a correction member which has a bending portion that divides the loading portion into an upstream side and a downstream side, and a stopper that is movable relative to the correction member, includes moving the correction member to a first position and the stopper to a closed position; moving the correction member to the first position and the stopper to an open position where the stopper moves toward the downstream side of the correction member and extends upward at a predetermined angle with respect to a horizontal surface; moving the correction member to a second position that is located higher than the first position and the stopper to the closed position; and moving the correction member to the second position and the stopper to the open position.

BRIEF DESCRIPTION OF THE DRAWINGS

An exemplary embodiment of the invention will be described in detail with reference to the following figures wherein.

DETAILED DESCRIPTION OF PREFERRED EMBODIMENTS

Figure 1:
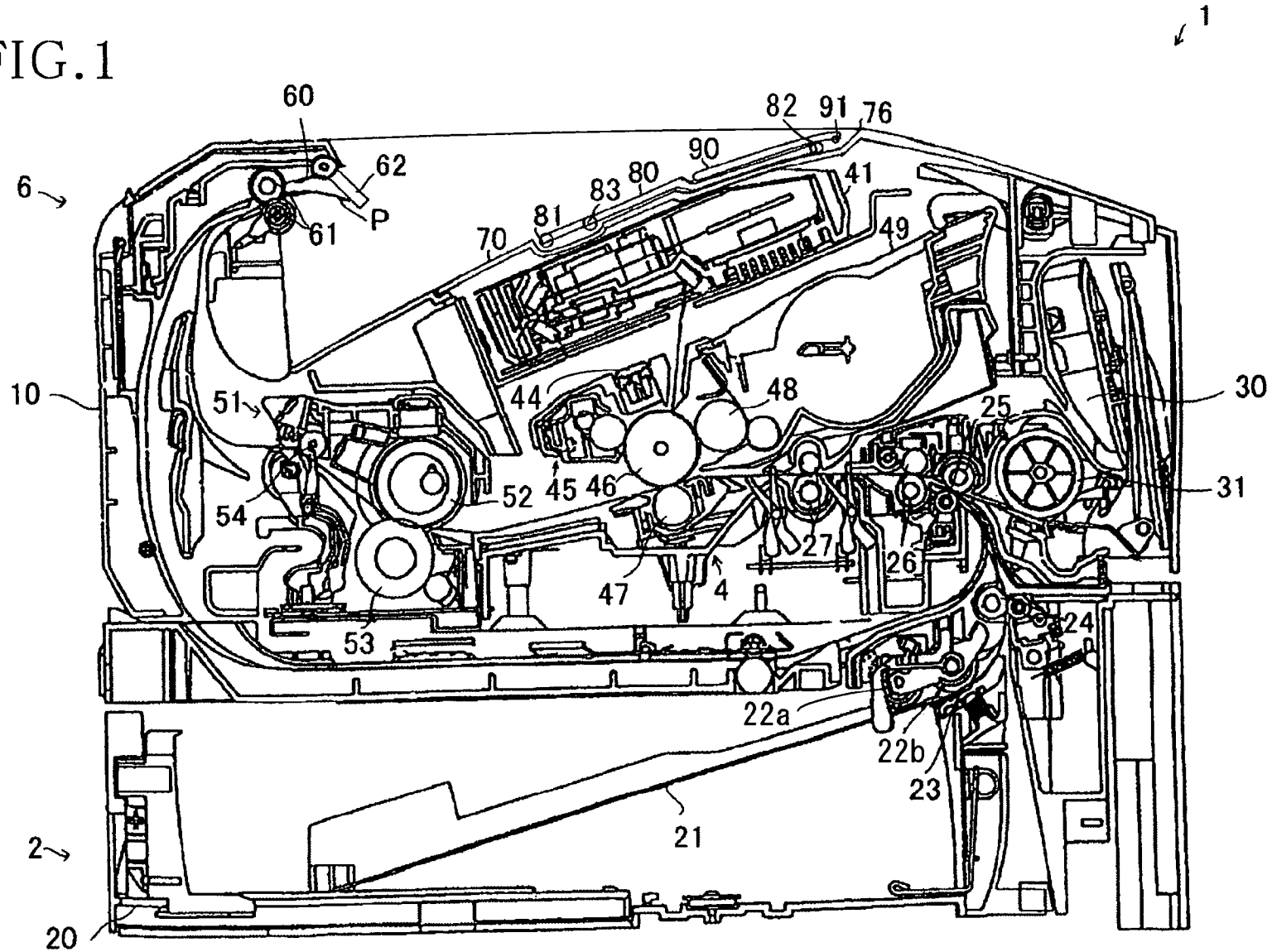
FIG. 1 is a side cross-sectional view of a printer according to an embodiment of the invention.
Figure 2:
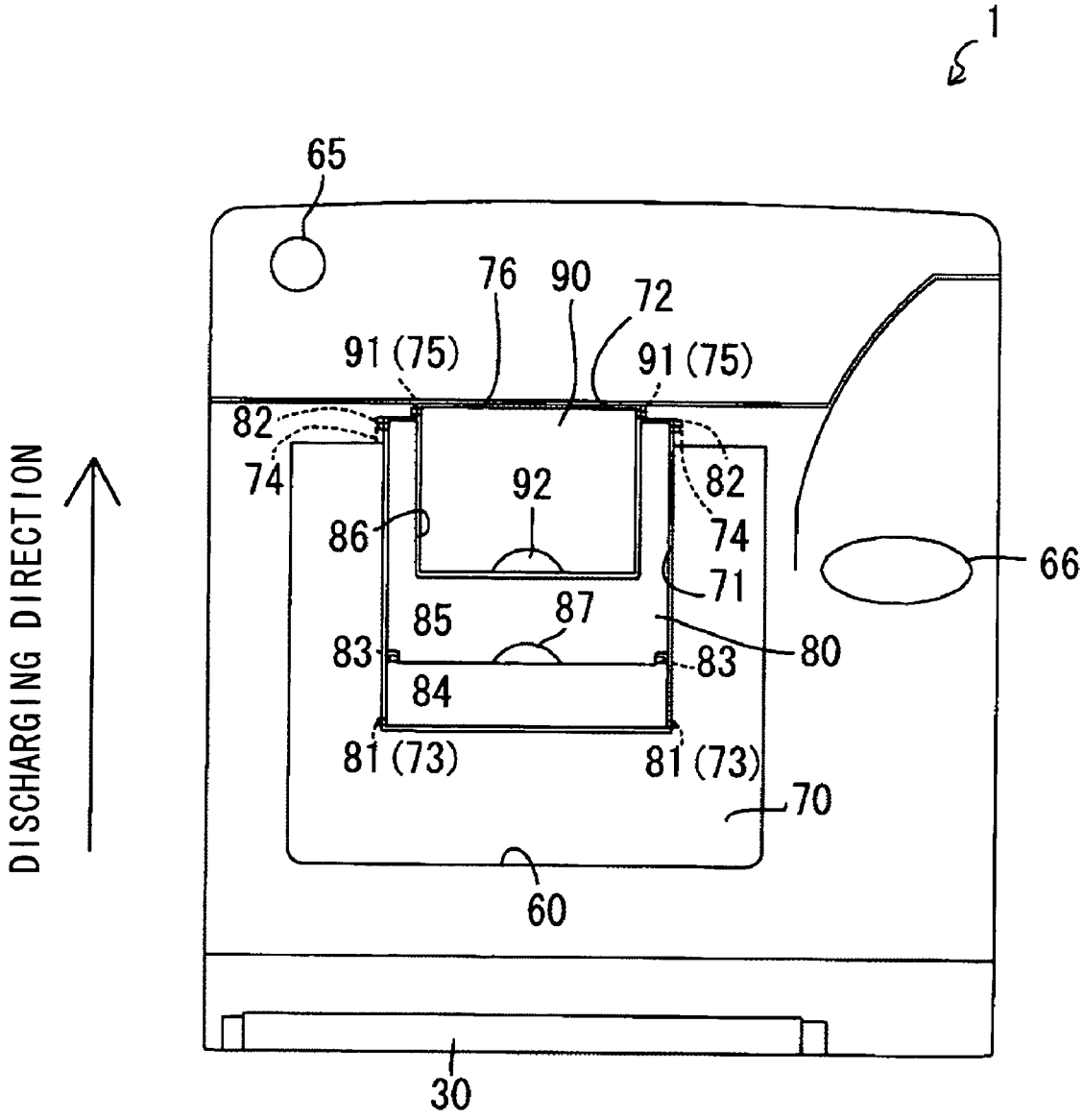
FIG. 2 is a top view of the laser printer of FIG. 1.

FIG. 1 is a side cross-sectional view of the laser printer 1 according to an embodiment of the invention and FIG. 2 is a top view of the laser printer 1 of FIG. 1. As illustrated in FIG. 1, within the frame 10 of the laser printer 1 there is a feeder part 2, an image formation part 4 and a paper exit part 6. The feeder part 2 stores the paper P, which is the recording sheet, and feeds the paper P to the image formation part 4. The image formation part 4 forms the image onto the supplied paper P. The paper exit part 6 emits the paper P onto which the image was formed by the image formation part 4.

The feeder part 2 comprises a box-type tray 20, a paper pressure plate 21, paper supply rollers 22*a* and 22*b*, a paper supply pad 23 pairs of resist rollers 24, 25, 26 and 27. The paper supply tray 20 is set such that it can adhere to the lower part of the frame 10. The paper pressure plate 21 is set in the lower part of the tray 20. Between the lower surface of the tray 20 and the pressure plate 21, there is a spring (not shown). The spring pushes the pressure plate 21 in the upward direction. The pressure plate 21 is supported such that it can move about one edge. When the pressure plate 21 moves upward due to the force of the spring, the paper P, which was loaded onto the pressure plate 21, will come into contact with the paper supply rollers 22*a* and 22*b* in the vicinity of the other edge.

The pair of paper supply rollers 22*a* and 22*b* and the paper supply pad 23 are set on the upper edge of the tray 20. The paper supply rollers 22*a* and 22*b* are arranged in the delivery direction of the paper. The paper supply roller 22*a* is positioned on the upstream side in the delivery direction. The paper supply roller 22*b* is positioned on the downstream side and arranged adjacent the paper supply pad 23 such that paper supply roller 22*b* and paper supply pad 23 face each other. On the back side of the paper supply pad 23, there is a spring which is not represented on the drawing. The paper supply pad 23 will face the paper supply roller 22*b* and will be pressed through the pressing force of the spring. Of the paper loaded into the paper pressure plate 21, the paper P which is positioned on top will be delivered to the downstream side in the delivery direction through the rotation of the paper supply rollers 22*a* and 22*b*. The paper P will be sandwiched between the paper supply roller 22*b* and the paper supply pad 23, separated into individual sheets, and delivered.

The resist rollers 24, 25, 26 and 27 are set on the downstream side in the delivery direction of paper P in relation to the paper supply rollers 22*a* and 22*b*. The paper P supplied by the paper supply rollers 22*a* and 22*b* will be sent to the image formation part 4 by the resist rollers 24, 25, 26 and 27.

On the frame 10, there is a manual-feed tray 30. It is possible to load multiple sheets of paper P onto the manual-feed tray 30, and through the rotation of the manual-feed roller 31, the paper P loaded onto the manual-feed tray 30 will be delivered.

The image formation part 4 includes the scanner unit 41, the process unit 45 and the adhesion part 51. The scanner unit 41 is set in the upper part of the frame 10. The laser light based on the given image data emitted from the laser diode will be refracted or reflected by the polygon mirror, lens and mirror on the scanner unit 41, and will be shone onto the surface of the exposure drum 46 of the process unit 45 to be described later.

The process unit 45 is attached to the frame 10 such that it can be removed, and consists of a charging unit 44, the exposure drum 46, an imaging roller 48, a transfer roller 47 and a toner box 49. When the process unit 45 is attached to the frame 10, the process unit 45 will be positioned on the lower side of the scanner unit 41.

There is toner stored in the toner box 49. The toner is provided to the imaging roller 48, becomes a film of a certain thickness, and applied to the surface of the imaging roller 48. The surface of the exposure drum 46, after it has been charged by the charging unit 44, will be exposed by laser light from the scanner unit 41. Based on the image data, a static-electricity image will be formed.

Through the rotation of the imaging roller 48, the toner applied onto the imaging roller 48, when it opposes the exposure drum 46, will be supplied to the static-electric image formed on the surface of the exposure drum 46 and the visible image will be formed.

The transfer roller 47 is arranged such that it can rotate in a direction opposite the exposure drum 46, on the lower side of the exposure drum 46. As a result of the bias effect applied by the transfer roller 47, the toner supplied to the exposure drum 46 will be transferred to the paper P. The transfer roller 47 will then deliver the paper P to the downstream side in the delivery direction.

The adhesion part 51 is, as illustrated in FIG. 1, arranged on the downstream side (the left side in FIG. 1) in the delivery direction of the paper P in relation to the process unit 45. The adhesion part 51 includes a heating roller 52 which has a heating element inside, a pressure roller 53 which applies pressure onto the heating roller 52, and a delivery roller 54 which is set on the downstream side of the heating roller 52 and the pressure roller 53.

In the adhesion part 51, when the paper P passes the heating roller 52 and the pressure roller 53, after the toner is transferred onto the paper P by the process unit 45, the toner will be fixed to the paper P through pressure. Thereafter, the paper P will be delivered to the paper exit part 6 by the delivery roller 54.

The paper exit part 6 contains a paper exit 60, a pair of paper delivery rollers 61 and a paper flattening component 62. On the upper surface of the frame 10, a loading surface 70 (i.e., an output tray) is formed which stacks the emitted paper P into layers. The pair of delivery rollers 61 is arranged in the vicinity of the paper exit 60. Through the rotation of the pair of delivery rollers 61, the paper P will be delivered to the loading surface 70.

The paper flattening component 62 is set on the downstream surface of the paper feed direction in relation to the paper delivery roller 61. Coming into contact with the paper P emitted from the paper exit 60 on the upper side, the paper delivery roller 61 ejects the paper P onto the loading surface 70. If the grain of the paper P is strong, then the paper P emitted from the paper exit 60 will pass on the upper side of the loading surface 70 in a re-curved form, and can be delivered over the loading surface 70. By using the paper flattening component 62, it is possible to send the paper P emitted from the paper exit 60 accurately in the direction of the loading surface 70.

As illustrated in FIG. 2, there is an LCD 66 and a switch 65 on the upper surface of the frame 10. LCD 66 shows information such as the status of the printer and the amount of toner remaining. The switch 65 is used to turn the power of the laser printer 1 ON/OFF.

Figure 3A:
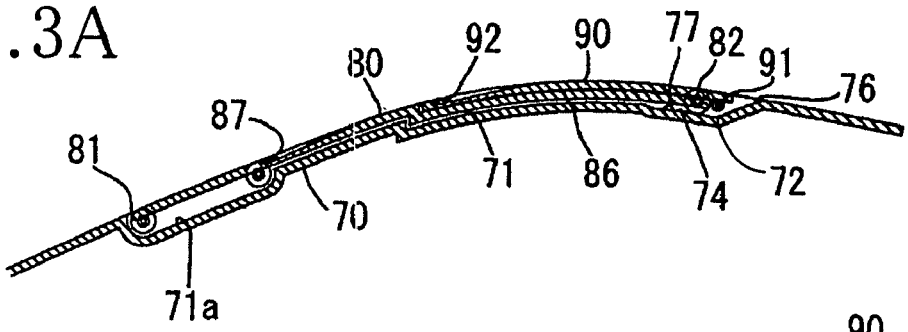
FIGS. 3A-3D are partial cross-sectional views of the loading surface of the laser printer of FIG. 1.
Figure 3B:
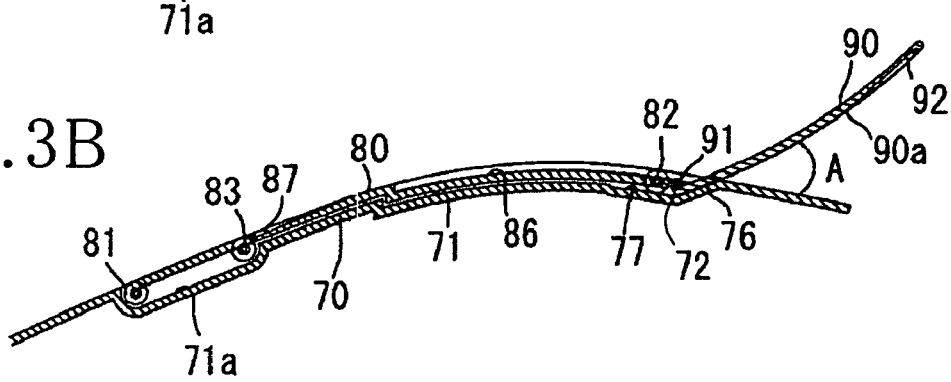
Figure 3C:
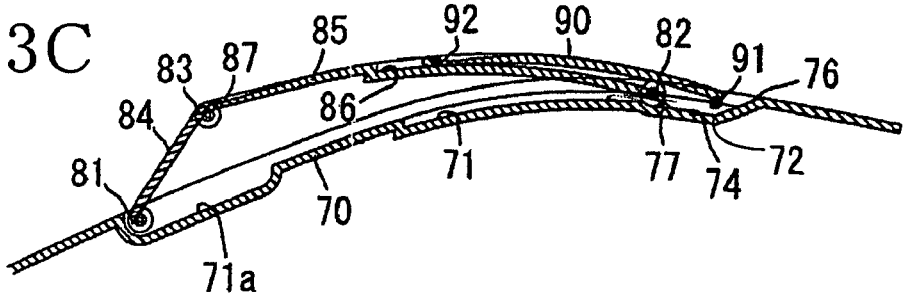
Figure 3D:
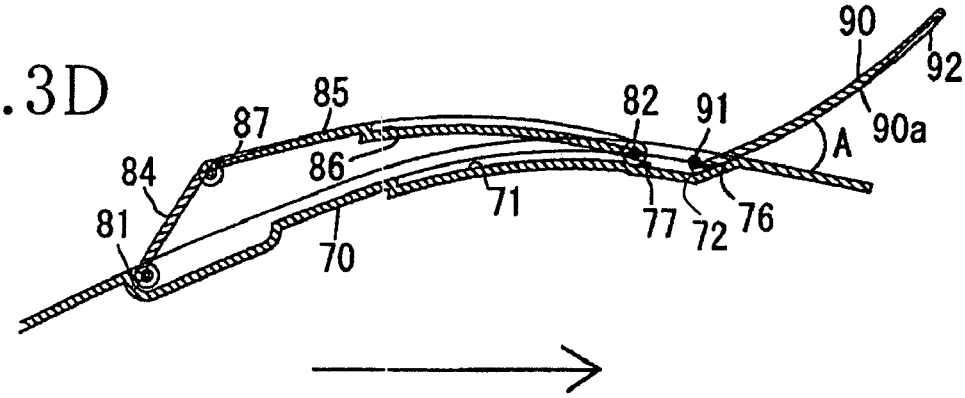

Next, while referring to FIG. 1, FIG. 2 and FIGS. 3A-3D illustrate the loading surface 70. FIGS. 3A-3D are partial cross-sectional views of the loading surface 70 and the position of the bridging component 80 and the stopper 90. FIG. 3A is the first state when the bridging component 80 is in the home position (i.e., a first position) and the stopper 90 is in the closed position. FIG. 3B is the second state when the bridging component 80 is in the home position and the stopper 90 is in the open position. FIG. 3C is the third state when the bridging component 80 is in an anti-curl position (i.e., a second position) and the stopper 90 is in the closed position. FIG. 3D is the fourth state when the bridging component 80 is in the anti-curl position and the stopper 90 is in the open position.

As illustrated in FIG. 1, the loading surface 70 has an edge on the lower side of the paper delivery roller 61, and is curved on the upper side following the feed direction of the paper P. The loading surface 70 is formed on the upper surface of the frame 10, facing the downstream side of the feed direction of the paper P from the paper exit 60, and is set such that it is wider than the widest paper which can be printed using the laser printer 1. The paper delivered by the paper delivery roller 61 is laminated and loaded onto the loading surface 70.

There is the bridging component 80 and the stopper 90 on the loading surface 70. On one part of the loading surface 70, there is a first concave part 71 which is concave facing the downstream side of the feed direction. In the first concave part 71, the bridging component 80 is accommodated. The width and length of the first concave part 71 is slightly wider and longer than the bridging component 80 when it is in the home position. The depth of the first concave part 71 is approximately the same as the thickness of the bridging component 80. In other words, when the bridging component is set in the home position, the upper surface of the loading surface 70 and the upper surface of the bridging component 80 connect smoothly.

As illustrated in FIG. 2, there is a locking part 76 along the width direction on the downstream edge of the first concave part 71. The locking part 76 is formed along the upper side, facing the downstream side of the feed direction (the right side in FIG. 3A.) As illustrated in FIGS. 3B and 3D, when the stopper 90 is moved into the open position, the stopper 90 and the locking part 76 come into contract to maintain the stopper 90 in the open position.

On the downstream side edge of the first concave part 71, there is a second concave part 72 which is narrower than the width of the first concave part 71, and which is connected to the first concave part 71.

As illustrated in FIG. 2, the bridging component 80 is formed of an upstream component 84 and a downstream component 85. The upstream component 84 and downstream component 85 are connected via the bending axis 83. By moving the bending axis 83 in an upward direction, it is possible for the bridging component 80 to bend the apex of the bending axis 83 to a convex form. On the downstream component 85, there is a third concave part 86 which is truncated. The width and length of the third concave part 86 is slightly larger than the width and length of the stopper 90, and the width of the third concave part 86 is approximately the same as that of the second concave part 72. As illustrated in FIG. 3A, when the stopper 90 is in the closed position, the stopper 90 is stored in the third concave part 86 and the second concave part 72.

The depth of the third concave part 86 is approximately the same as the thickness of the stopper 90. In other words, when the stopper 90 is in the closed position, the surface of the stopper 90 will come into smooth contact with the surface of the bridging component 80, and it is therefore possible to prevent loading rejects when the paper P is loaded.

The length of the downstream component 85 is longer than that of the upstream component 84. If the ratio of the length of the upstream component 84 and the downstream component 85 is specified, then by bending the bridging component 80 to be convex over the upper side of the bending axis 83, the curl of the emitted paper P will be flattened, and it is sufficient to set the second concave part 86 on the downstream component 85.

As illustrated in FIG. 2, there is a bearing 75 on the downstream side edge of the second concave part 72. When the stopper 90 is in the closed position, there is a rotational axis 91 which extends the width of the paper P formed on the downstream side edge of the stopper 90. Both edges of the rotational axis 91 are supported by the bearing 75. By rotating the stopper 90 about the rotational axis 91, the stopper moves between the open position and the closed position.

On the upstream side edge of the upstream component 84, there is a fixed axis 81 which extends in the width direction of the paper P, and on the downstream edge of the downstream component 85, there is a movable axis 82 which extends in the width direction of the paper P.

As illustrated in FIG. 2, a bearing 73 is formed on the upstream side edge on the surface of both sides of the first concave part 71, and fixed axis 81 is connected to the bearing 73.

Bearing groove 74 is formed on the downstream side on the surface of both sides of the first concave part 71, and the movable axis 82 is connected to the bearing groove 74.

When the bending axis 83 is moved in the upward direction, the movable axis 82 follows the bearing groove 74, and moves in an upstream direction relative to the feed direction. When the bending axis 83 is moved in an downward direction, the movable axis 82 follows the bearing groove 74 and moves in a downstream direction relative to the feed direction.

As illustrated in FIGS. 3A-3D, on the lower surface of the bearing groove 74, there is a rib 77. When the movable axis 82 of the bridging component 80 is moved along the bearing groove 74, it is necessary for the bridging component 80 to move over the rib 77.

As illustrated in FIG. 3A, on the upstream side edge of the first concave part 71, there is a groove 71 a which stores the fixed axis 81 of the bridging component 80 and the bending axis 83. Near the bending axis 83 of the downstream component 85, there is a knob 87. When the user pulls out the knob 87 with his fingers, the bending axis 83 moves in an upward direction, and the bridging component 80 forms a convex form about the bending axis 83.

When the bridging component 80 is in the home position as illustrated in FIG. 3A, if the user pulls the knob 87, the movable axis 82 slides along the bearing groove 74 and the bending axis 83 will move upward. As illustrated in FIG. 3C, when the movable axis 82 is slid over the rib 77, the bridging component 80 will bend into a convex form about the bending axis 83, and the movable axis 82 will remain in contact with the rib 77 (anti-curl position). In the anti-curl position, the upstream component 84 will bend in an downward direction about the bending axis 83, and the downstream component 85 will bend to the lower direction of the downstream side. When the bridging component 80 is in the anti-curl position, the movable axis 82 will hit the rib 77 on the bearing axis 74, and the bridging component 80 will not naturally return to the home position.

When the bridging component 80 is in the anti-curl position, if the user pushes the bending axis 83 from above, the movable axis 82 will move towards the downstream side in the feed direction following the bearing groove 74 over the rib 77. As illustrated in FIG. 3A, and the bridging component 80 will return to the original home position.

As illustrated in FIG. 3B, when the stopper 90 is moved from the closed position to the open position about the rotating axis 91, the back side 90*a* of the stopper 90 will come into contact with the locking part 76 on the loading surface 70. As a result of this contact, the stopper 90 will remain in the open position. The back side 90*a* of the stopper 90 in this position is at an angle A to the loading surface 70, which is approximately 30 degrees. Angle A can be the angle where the paper P does not slide off from the downstream side edge of the loading surface 70, and can extend upward from the horizontal plane.

Stopper 90 is not attached to the bridging component 80, and can be stored such that it overlaps with the third concave part 86 on the bridging component 80. In other words, when the stopper 90 is in the closed position, even when the bridging component 80 is moved to the anti-curl position, the position of the stopper 90 will not change, and only the lower surface of the third concave part 86 and the stopper 90 will contact.

As illustrated in FIG. 2, when the stopper 90 is in the closed position, there is a knob 92 on the upstream side edge of the stopper 90. When the user pulls the knob 92 with his fingers, the stopper 90, which is in the closed position, will rotate about the rotating axis 91, and will move to the open position.

By combining the positions of the bridging component 80 and the stopper 90, it is possible to set the status of the loading surface 70 onto which the paper P is loaded into the four types illustrated in FIGS. 3A-3D as described above. The form of the paper P to be emitted will change depending on the type of paper P and the printing environment. If, based on the form of the paper P, the positions of the bridging component 80 and the stopper 90 are selected from among the four types, it is possible to prevent the paper P from curling, or to prevent the paper P from sliding off of the loading surface 70.

For instance, in the event that the center of the paper P emitted from the paper exit 60 is concave, and generates a cylindrical curl such that it moves to the outer side in the width direction, as illustrated in FIG. 3C, by pulling up on the knob 87, the bridging component 80 will move from the home position to the anti-curl position, and the bridging component 80 will be bent into a convex form. When the bridging component 80 is in the anti-curl position, the paper P which has generated a cylindrical curl will be sent in the upward direction such that the paper P arrives at the bending axis 83, and after passing the bending axis 83, the paper will be sent in the downward direction. In this way, when the paper P passes over the bending axis 83, the cylindrical curl generated by the paper P will be rectified.

Further, in the event that multiple sheets of paper P are printed in sequence, if it appears that the paper P is going to slide off from the downstream side of the loading surface 70, as illustrated in FIG. 3D, if the knob 92 is pulled when the bridging component 80 is in the anti-curl position, then the stopper 90 will move from the closed position to the open position. By doing this, the edge of the emitted paper P will come into contact with the stopper 90, and it will be possible to prevent the paper P from sliding off.

As the state of the paper P which is emitted can change depending on the type of paper P or the printing environment, the user can look at the state of the paper P which is emitted, and select the positions of the bridging component 80 and the stopper 90 as appropriate to the situation.

As illustrated in FIGS. 3B and 3D, the rotating axis 91 of the stopper 90 is attached on the bearing 75 (shown in FIG. 2) of the second concave part 72 on the loading surface 70 such that even if the bridging component 80 is in the anti-curl position, the position of the rotating axis 91 of the stopper 90 remains constant. In other words, regardless of the status of the bridging component 80, the angle A formed between the back side 90*a* of the stopper 90 and the loading surface 70 when the stopper 90 is in the open position is constant, and it is possible to ensure the efficacy of preventing the emitted paper P from sliding off of the loading surface 70.

Figure 4:
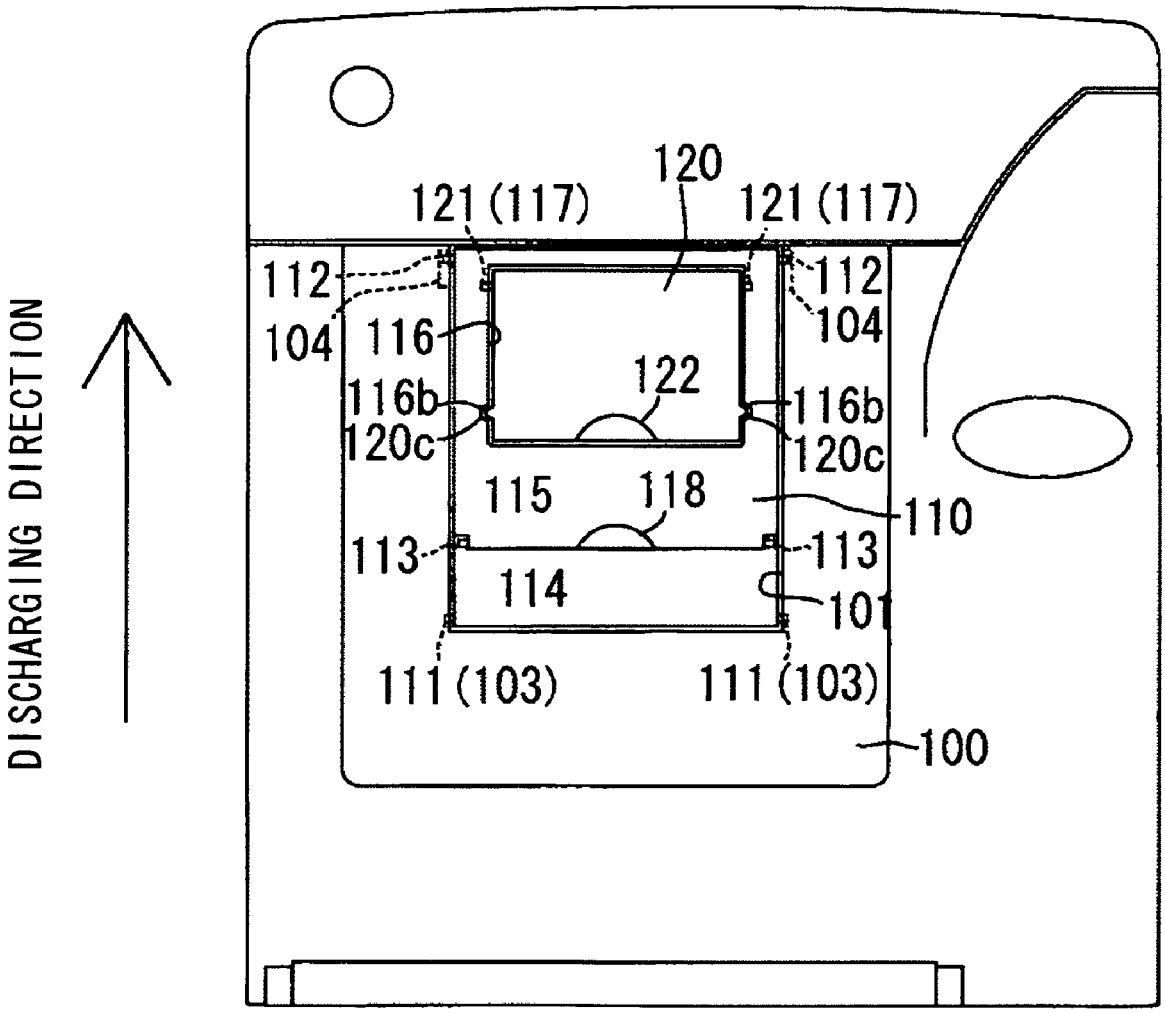
FIG. 4 is a top view of another laser printer.

A laser printer 1 according to a second embodiment will now be explained by referring to FIGS. 4 and 5A-5D. FIG. 4 is a top view of the laser printer 1 which illustrates the second embodiment. FIGS. 5A-5D are partial cross-sectional views of the loading surface 100 of the second embodiment. Other than the structural items explained below, the form of the second embodiment is the same as that of the first embodiment.

The loading surface 100 of the second embodiment includes a bridging component 110, which is similar to that of the first embodiment, and a stopper 120.

Figure 5A:
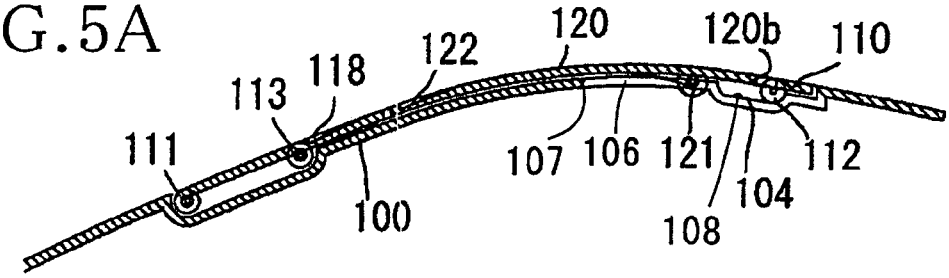
FIGS. 5A-5D are partial cross-sectional views of the loading surface of the laser printer of FIG. 4.
Figure 5B:
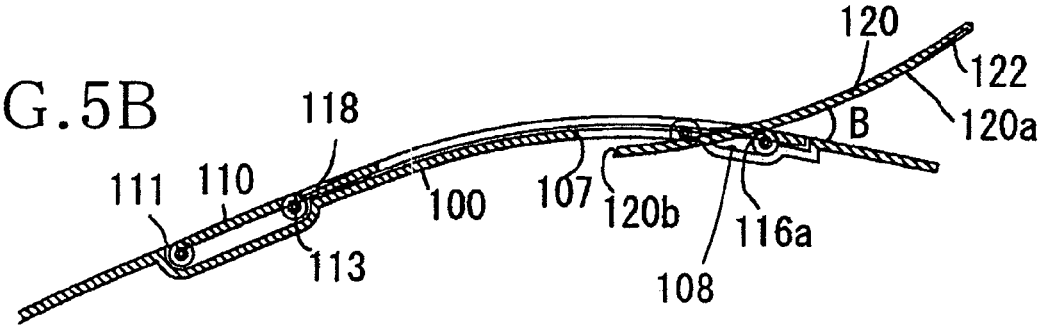
Figure 5C:
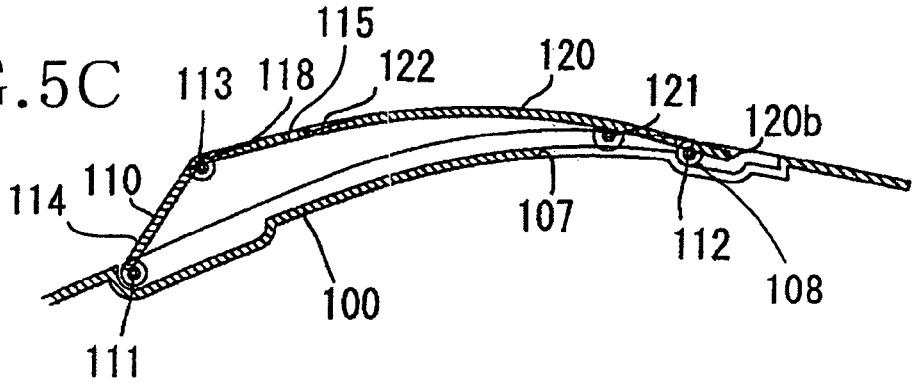
Figure 5D:
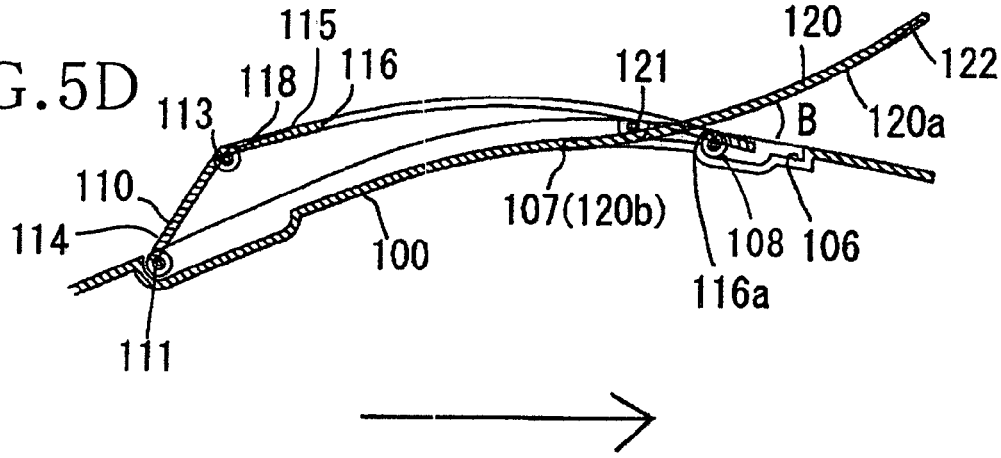
Figure 6:
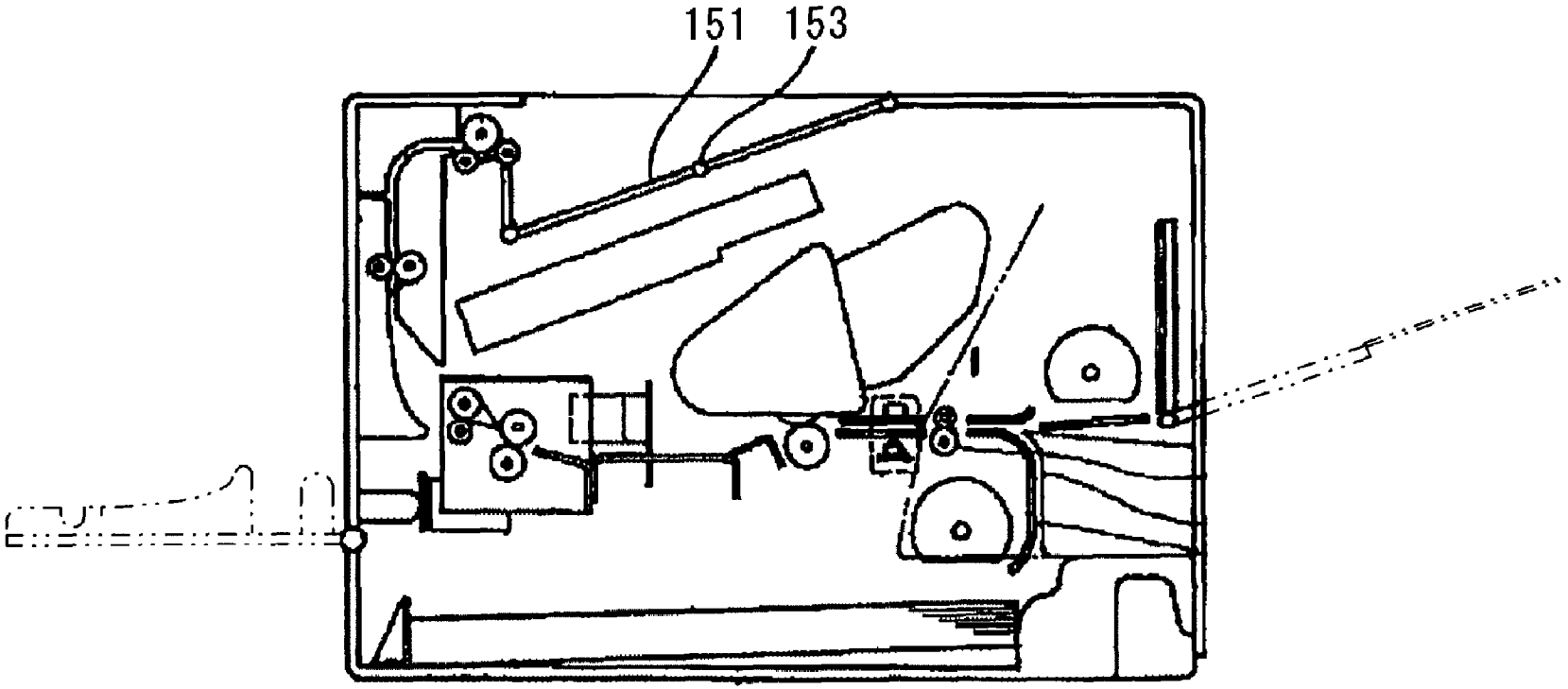
FIG. 6 is a side cross-sectional view of a related laser printer.

FIG. 5A shows the state when the bridging component 110 is in the home position and the stopper 120 is in the closed position. FIG. 5B shows the state when the bridging component 110 is in the home position and the stopper 120 is in the open position. FIG. 5C shows the state when the bridging component 110 is in the anti-curl position and the stopper 120 is in the closed position. FIG. 5D shows the state when the bridging component 110 is in the anti-curl position and the stopper 120 is in the open position.

There is a bridging component 110 and a stopper 120 attached to the loading surface 100. On one part of the loading surface 100, there is formed a concave part 101 which faces the downstream side of the feed direction. On the concave part 101, there is a bridging component 110. The width and length of the concave part 101 is slightly larger than the width and length of the bridging component 110 when it is in the home position. The depth of the concave part 101 is approximately the same as the thickness of the bridging component 110. Thus, when the bridging component 110 is in the home position, the upper surface of the loading surface 100 and the upper surface of the bridging component 110 are smoothly connected.

As illustrated in FIG. 4, the bridging component 110 consists of an upstream component 114 and a downstream component 115. The upstream component 114 and the downstream component 115 are connected via the bending axis 113. By moving the bending axis 113 in the upward direction, the bridging component 110 can be bent to a convex form about the bending axis 113.

The length of the downstream component 115 is longer than that of the upstream component 114. Since the ratio of the length of the upstream component 114 and the downstream component 115 is not particularly specified, by bending the bridging component 110 to be convex over the upper side of the bending axis 113, the curl of the emitted paper P will be flattened.

On the upstream side edge of the upstream component 114, there is a fixed axis 111 which extends in the width direction of the paper P, and on the downstream side edge of the downstream component 115, there is a movable axis 112 which extends in the width direction of the paper P.

As illustrated in FIG. 4, on the upstream side edge of the surface of both sides of the concave part 101, there is formed a bearing 103, and the fixed axis 111 is connected to the bearing 103.

On the downstream side of the surface of both sides of the first concave part 101, there is formed a bearing groove 104, and the bearing groove 104 is connected to the movable axis 112.

Near the bending axis 113 of the downstream component 115, there is a knob 118. When the user pulls out the knob 118 with his fingers, the bending axis 113 moves in an upward direction, and the bridging component 110 forms a convex form about the bending axis 113.

When the bending axis 113 is moved in the upward direction, the movable axis 112 follows the bearing groove 104, and moves in the direction of the upstream edge of the feed direction. When the bending axis 113 is moved in an downward direction, the movable axis 112 follows the bearing groove 104 and moves to the downstream side of the feed direction.

As illustrated in FIGS. 5A-5D, on the lower surface of the bearing groove 104, there is a rib 108. When the movable axis 112 of the bridging component 110 is moved along the bearing groove 104, it is necessary for the bridging component to move over the rib 108.

When the bridging component 110 is in the home position as illustrated in FIG. 5A, if the user pulls the knob 118, while the movable axis 112 slides along the bearing groove 104, the bending axis 113 will move upward. As illustrated in FIG. 5C, when the movable axis 112 is slid over the rib 108, the bridging component 110 will bend into a convex form about the bending axis 113, and the movable axis 112 will remain in contact with the rib 108 (the anti-curl position).

In the anti-curl position (FIGS. 5C and 5D), the upstream component 114 will bend in an downward direction about the bending axis 113, and the downstream component 115 will bend to the lower direction of the downstream side. When the bridging component 110 is in the anti-curl position,, the movable axis 112 will hit the rib 108 on the bearing axis 104, and the bridging component 110 will not naturally return to the home position.

When the bridging component 110 is in the anti-curl position, if the user pushes the bending axis 113 from above, the movable axis 112 will move towards the downstream side in the feed direction following the bearing groove 104 over the rib 108, and as illustrated in FIG. 3A, the bridging component 110 will be in the original home position.

On the downstream side in the feed direction of the concave part 101 (the right side in FIG. 5A), there is a truncated hole 106 which is slightly wider than the width of the stopper 120.

There is a rotating axis 121 on both edges in the width direction of the stopper 120. The length from a downstream edge 120*b*, which is the edge of the downstream side in the feed direction of the stopper 120 to the rotating axis 121, is approximately twice the overall length in the feed direction of the stopper 120.

As illustrated in FIG. 4, the bridging component 110 has a truncated hole 116 which is slightly larger than the overall stopper 120 such that the truncated hole fits around the stopper 120. One part of the hole 116 is connected to the hole 106. On the surface of both sides of the hole 116, a bearing 117, and a rotating axis 121 of the stopper 120 is attached on the bearing 117. The width of the hole 116 is approximately the same as the width of the hole 106, but the length of hole 116 is larger.

There is a knob 122 on the upstream side edge of the stopper 120. If the user pulls up on the knob 122, and rotates the stopper 120 about the rotating axis 121, the stopper 120 can be moved between the closed position shown in FIG. 5A and the open position shown in FIG. 5B.

On the surface of both sides of the hole 116, there is a notch 116*b* located in a position separate from the bearing 117. On a given position on the width of the stopper 120, there is a convex part 120*c*. When the stopper 120 is in the closed position, the convex part 120*c* comes into contact with the notch 116*b*, and the stopper 120 will be kept in the closed position.

When the stopper 120 is rotated, the downstream edge 120*b* of the stopper 120 connects to both the hole 106 and the hole 116. As illustrated in FIG. 5D, when the bridging component 110 is in the anti-curl position and the stopper 120 is in the open position, the downstream edge 120*b* of the stopper 120 will come into contact with the upstream edge 107 of the hole 106, and the stopper 120 will be kept in that position. At this time, the angle B formed by a back side 120*a* of the stopper 120 and the loading surface 100 will be approximately 30°.

The length from the back edge 120*b* of the stopper 120 and the rotating axis 121 is set such that the angle B will be approximately 30° when the bridging component 110 is in the anti-curl position and the stopper 120 is in the open position.

Next, the operation of the bridging component 110 and the stopper 120 using FIGS. 5A-5D will be explained.

In the state illustrated in FIG. 5A, the bridging component 110 is in the home position, and is stored within the concave part 101 of the loading surface 100. Setting the stopper 120 in the closed position, the protruding part 120*c* and the notch 116 are lined up. At this time, the bridging component 110 and the stopper 120 are smoothly connected.

When the stopper 120 is rotated about the rotating axis 121, the stopper 121 is moved from the closed position shown in FIG. 5A to the open position shown in FIG. 5B. There are holes 116 and 106 set on the bridging component 110 and the loading surface 100 respectively. The downstream edge 120*b* of the stopper 120 is connected to the holes 116 and 106. When the downstream edge 116*a* of the hole 116 comes into contact with the back surface 120*a* of the stopper 120, the stopper 120 will be kept in the open position. The angle B of the back surface 120*a* of the stopper 120 when the stopper 120 is in the open position is achieved and the loading surface 100 extends upward from the horizontal plane. As such, the emitted paper P will not slide off of the loading surface 100.

When the knob 118 is pulled up from the state shown in FIG. 5A, the bridging component 110 will move to the anti-curl position shown in FIG. 5C. In the anti-curl position, the bridging component 110 will bend to a convex form about the bending axis 113, and the movable axis 112 of the bridging component 110 will slide towards the upstream side in the feed direction. The stopper 120 supported by the bridging component 110 will also move to the upstream side in the feed direction in the same way as the bridging component 110.

As the convex part 120*c* of the stopper 120 is supported by the notch 116*b* of the bridging component 120, the stopper 120 will remain in the closed position.

When the bridging component 110 is in the anti-curl position as shown in FIG. 5C, the stopper 120 will rotate about the rotating axis 121 and will move from the closed position to the open position shown in FIG. 5D.

As illustrated in FIG. 5D, the downstream edge 120*b* of the stopper 120 rotates connected to the holes 116 and 106, and before the back surface 120*a* of the stopper 120 comes into contact with the back edge 116*a* of the hole 116, the stopper will come into contact with the upstream edge 107 of the hole 106. When the stopper 120 is in contact with the upstream edge 107, the stopper 120 will remain in the open position. The angle B formed by the back surface 120*a* of the stopper 120 and the loading surface 100 will be approximately 30°.

Conversely, if the back surface 120*a* of the stopper 120 comes into contact with the back edge 116*a*, and the stopper 120 is maintained, then the angle formed by the back surface 120*a* of the stopper 120 and the loading surface 100 is not approximately 30°. In fact, the back surface 120*a* of the stopper 120 and the loading surface 100 will be approximately horizontal, thus causing the paper P to slide off of the loading surface 100.

As illustrated in FIG. 5B, we will explain the movement of the bridging component 110 to the anti-curl position when the bridging component 110 is in the home position and the stopper 120 is in the open position.

In the state shown in FIG. 5B, the back surface 120*a* of the stopper 120 is in contact with the back edge 11 6*a* of the hole 116. By pulling up the knob 118 of the bridging component 110 and lifting the bending axis 113, the movable axis 112 will be moved in the upward direction, and following that movement, the rotating axis 121 of the stopper 120 will also move in the upward direction.

While the downstream edge 120*b* of the stopper 120 comes into contact with the upstream edge 107 of the hole 106, the back surface 120*a* of the stopper 120 will come into contact with the back edge 116*a* of the hole 116. While the bridging component 110 is moving from the home position into the anti-curl position, the back edge 120*a* of the stopper 120 will come into contact with the upstream edge 107 of the hole 106. After that, as the movable axis 112 moves towards the upstream side, the back surface 120*a* and the back edge 116*a* will separate, and the rotating axis 121 will move upward.

The angle formed by the back surface 120*a* of the stopper 120 and the loading surface 100 will gradually reduce from 30° until the back edge 120*b* of the stopper 120 and the touching part 107 come into contact, but after the back edge 120*b* of the stopper 120 comes into contact with the touching part 107, it will once again return to an angle of 30°.

The effective location in maintaining the open position of the stopper 120 will differ when the bridging component 110 is in the home position and when the bridging component is in the anti-curl position. However, based on the improvements discussed above, regardless of the status of the bridging component 110, it is possible to maintain a certain angle between the back surface 120*a* of the stopper 120 and the loading surface 100 while in the home position, and to consistently prevent the paper P from sliding off of the surface 100.

As illustrated in FIG. 5A, as the upstream edge 107 of the hole 106 is formed such that the cross-section is at an angle, when the bridging component 110 is shown in FIG. 5D in the anti-curl position, and the stopper 120 is in the open position, it is possible to ensure contact between the downstream edge 120*b* of the stopper 120 and the upstream edge 107 of the hole 106, and to stabilize the stopper 120.

While the invention has been described with reference various embodiments, the description of the embodiments is illustrative only and is not to be construed as limiting the scope of the invention. Various other modifications and changes may occur to those skilled in the art without departing from the spirit and scope of the invention.

The movable axis of the bridging component, while being the axis of the downstream side in the feed direction, can also be the axis of the upstream side. Furthermore, both the downstream side and upstream side can be movable axes.

The movement of the bridging component and the stopper detects the type of paper by sensors on the laser printer. Depending on the results of that detection, it is possible to rotate the gears by driving the motor, and in this case, it is possible to reduce the labor on the part of the user.

In the second embodiment, when the bridging component is in the home position, the stopper is kept in the open position through contact with the bridging component. With a locking part on the loading surface, it is also possible to maintain the stopper in the open position through contact with the locking part.

In the second embodiment, the hole formed on the bridging component is larger than the hole formed on the loading surface. By making it the same shape as the hole formed on the loading surface, it is possible to form a convex part in the bridging component to store the stopper.

According to an exemplary aspect of an image formation device, because it is possible to obtain a first position and a second position of the bending axis, it is possible to take a convex form with the apex at the bending axis when the correction member is in a flat form. Therefore, even if the recording sheet is curled cylindrically and must be discarded due to the type of recording sheet or to the environment at the time of printing, by ironing out the curl, it is possible to prevent loading rejects or knock-on problems. Further, regardless of the state of the correction member, the edge of the stopper in the operation position will extend above that level, and therefore, it is possible to prevent the recording sheet which is emitted from the device to slide off and fall due to the momentum from delivery.

According to an exemplary aspect of an image formation device, since the rotational axis of the stopper is attached to the loading part, regardless of the position of the recording sheet rectifying component, the angle of the stopper which is on the operation position will remain constant.

According to an exemplary aspect of an image formation device when the stopper is in the storage position, the stopper will be supported by the correction member such that the stopper can slide, even if the bending axis is in the second position, it will be possible to support the stopper in the storage position.

According to an exemplary aspect of an image formation device, since the stopper is connected to the loading part, the angle will be accurately determined by the operation position of the stopper.

According to an exemplary aspect of an image formation device, the rotational axis of the stopper is attached to the correction member, and the stopper axis will move with the movement of the bending axis. In this type of structure, regardless of the form of the correction member, it is possible to make the relative position of the emitted recording sheet and the stopper the same, and it is therefore possible to consistently prevent the sliding off of the recording sheet.

According to an exemplary aspect of an image formation device, regardless of the position of the bending axis, or of the form of the correction member, since the angle of the stopper in the operation position is maintained, it is possible to still more consistently prevent the sliding off of the recording sheet.

According to an exemplary aspect of an image formation device, the alignment position of the stopper when it is in the operation position will differ from its position when the bending axis is in the first position and when it is in the second position. When the bending axis is in the first position, the alignment of the back side of the stopper and the correction member will be determined by their contact. When the bending axis is in the second position, the alignment will be determined by contact of the back edge which extends even further back than the rotational axis of the stopper and the loading part. Thus, regardless of the form of the correction member, the angle of the stopper will consistently be fixed, and it will be possible to prevent the sliding off of the recording sheet.

According to an exemplary aspect of an image formation device, since the correction member and the stopper, in the set positions, are such that they can form the same surface as the loading part of the device, a continuous surface is formed, and it is possible to prevent the edge of the emitted recording sheet from getting caught in the correction member or in the stopper. Thus, it is possible to prevent loading problems in the recording sheet.

According to an exemplary aspect of an image formation device, only the axis formed on one edge of the correction member is attached such that it can slide. Therefore, the position of the apex of the correction member will be in the same position, and will not differ each time the bending axis moves from the first position to the second position. Therefore, the status of the recording sheet curl will not change when it is emitted, and will emerge stably. Further, the change from the first position to the second position and from the second position to the first position will be smooth.

According to an exemplary aspect of an image formation device, as the loading surface is the upper surface of the device, it is possible to sufficiently provide the loading surface without providing a special space. Further, since it is possible to broadly set the loading surface, it is possible to provide the bending axis of the correction member and the stopper in a favorable position.

What is claimed is:

1. An image forming apparatus, comprising:

a loading portion that is capable of receiving a recording sheet, wherein the loading portion includes:

a correction member which has a bending portion that divides the loading portion into an upstream side and a downstream side, wherein the bending portion selectively moves between a first position and a second position, the second position being located higher than the first position, a stopper that selectively moves between a closed position in which the stopper is stored in the correction member and an open position in which the stopper moves toward the downstream side of the correction member, wherein the stopper selectively rotates about a rotation axis, and wherein the stopper extends upward at a predetermined angle with respect to a horizontal surface when the stopper is at the open position, and an engaging portion that is located on a downstream side of the rotation axis, where the stopper contacts the engaging portion when the stopper is at the open position to support the stopper in the open position, and wherein the downstream side of the loading portion is substantially longer than the upstream side of the loading portion when the correction member is located at the second position, wherein the rotation axis of the stopper is fixed to the loading portion, and wherein the stopper is slidably stored in the correction member at the closed position.

2. The image forming apparatus as set forth in claim 1, wherein:

the stopper contacts the engaging portion when the stopper is at the open position and the bending portion is at the first position and the second position.

3. The image forming apparatus as set forth in claim 1, wherein the rotation axis of the stopper is fixed to the correction member.

4. The image forming apparatus as set forth in claim 3, wherein the angle of the stopper with respect to the horizontal surface when the stopper is at the open position is constant regardless of the position of the bending portion.

5. The image forming apparatus as set forth in claim 4, wherein when the bending portion is at the first position and the stopper is at the open position, the stopper is positioned by a rear surface of the stopper contacting the correction member, and when the bending portion is at the second position and the stopper is at the open position, a rear end of the stopper is positioned by contacting the loading portion.

6. The image forming apparatus as set forth in claim 1, wherein when the bending portion is at the first position and the stopper is at the closed position, the correction member and the stopper form a common surface.

7. The image forming apparatus as set forth in claim 6, wherein one end of the correction member is slidably attached to the loading portion, and another end is fixed to the loading portion.

8. The image forming apparatus as set forth in claim 1, further comprising a paper discharging roller that feeds the recording sheet onto the loading portion, wherein a loading surface is formed on a top surface of a casing of an apparatus main body, and one end of the loading surface is arranged under the paper discharging roller and is upwardly curved toward a feeding direction of the recording sheet.

9. The image forming apparatus according to claim 1, wherein the stopper is not attached to the correction member and the stopper is capable of being stored such that the stopper overlaps a part of the correction member.

10. An image forming apparatus, comprising:

a loading portion that is capable of receiving a recording sheet, wherein the loading portion includes:

a correction member which has a bending portion that divides the loading portion into an upstream side and a downstream side, a stopper that is movable relative to the correction member, the stopper selectively rotating about a rotation axis, and an engaging portion located on a downstream side of the rotation axis, wherein the correction member and the stopper are capable of selectively achieving:

a first state where the correction member is at a first position and the stopper is at a closed position, a second state where the correction member is at the first position and the stopper is at an open position where the stopper moves toward the downstream side of the correction member and extends upward at a predetermined angle with respect to a horizontal surface, and wherein the stopper contacts the engaging portion to support the stopper in the open position in the second state, a third state where the correction member is at a second position that is located higher than the first position and the stopper is at the closed position, and a fourth state where the correction member is at the second position and the stopper is at the open position, and wherein the downstream side of the loading portion is substantially longer than the upstream side of the loading portion when the correction member is located at the second position, wherein the rotation axis of the stopper is fixed to the loading portion, and wherein the stopper is slidably stored in the correction member at the closed position.

11. The image forming apparatus as set forth in claim 10, wherein:

the stopper contacts the engaging portion when the stopper is at the open position and the bending portion is at the first position and the second position.

12. The image forming apparatus as set forth in claim 10, wherein the stopper selectively rotates and a rotation axis of the stopper is fixed to the correction member.

13. The image forming apparatus as set forth in claim 12, wherein the angle of the stopper with respect to the horizontal surface when the stopper is at the open position is constant regardless of the position of the bending portion.

14. The image forming apparatus as set forth in claim 13, wherein when the bending portion is at the first position and the stopper is at the open position, the stopper is positioned by a rear surface of the stopper contacting the correction member, and when the bending is at the second position and the stopper is at the open position, a rear end of the stopper is positioned by contacting the loading portion.

15. An image forming apparatus, comprising:

a loading portion that is capable of receiving a recording sheet, wherein the loading portion includes:

a correction member which has a bending portion, wherein the bending portion selectively moves between a first position and a second position that is located higher than the first position, a stopper that selectively moves between a closed position and an open position in which the stopper extends upward at a predetermined angle with respect to a horizontal surface, wherein the stopper selectively rotates about a rotation axis, and an engaging portion that is located on a downstream side of the rotation axis, where the stopper contacts the engaging portion when the stopper is at the open position to support the stopper in the open portion, wherein the downstream side of the loading portion is substantially longer than the upstream side of the loading portion when the correction member is located at the second position, wherein the rotation axis of the stopper is fixed to the loading portion, and wherein the stopper is slidably stored in the correction member at the closed position.

16. A method of operating a loading portion that is capable of receiving a recording sheet, wherein the loading portion includes a correction member which has a bending portion that divides the loading portion into an upstream side and a downstream side, and a stopper that is movable relative to the correction member and selectively rotates about a rotation axis, the method comprising:

moving the correction member to a first position and the stopper to a closed position;

moving the correction member to the first position and the stopper to an open position where the stopper moves toward the downstream side of the correction member and extends upward at a predetermined angle with respect to a horizontal surface, wherein the stopper contacts an engaging portion when the stopper is in the open position and the correction member is in the first position to support the stopper in the open position, the engaging portion being located on a downstream side of the rotation axis;

moving the correction member to a second position that is located higher than the first position and the stopper to the closed position; and moving the correction member to the second position and the stopper to the open position, wherein the downstream side of the loading portion is substantially longer than the upstream side of the loading portion when the correction member is located at the second position, wherein the rotation axis of the stopper is fixed to the loading portion. and wherein the stopper is slidably stored in the correction member at the closed position.

17. An image forming apparatus, comprising:

a loading portion that is capable of receiving a recording sheet, wherein the loading portion includes:

a correction member which has a bending portion that divides the loading portion into an upstream side and a downstream side, wherein the bending portion selectively moves between a first position and a second position, the second position being located higher than the first position, and a stopper that selectively moves between a closed position in which the stopper is stored in the correction member and an open position in which the stopper moves toward the downstream side of the correction member, wherein the stopper extends upward at a predetermined angle with respect to a horizontal surface when the stopper is at the open position, wherein the stopper selectively rotates and a rotation axis of the stopper is fixed to the loading portion, and wherein the stopper is slidably stored in the correction member at the closed position.

* * * * *